US005109571A

United States Patent [19]

Ohshima et al.

[11] Patent Number: 5,109,571

[45] Date of Patent: May 5, 1992

[54] DOOR HINGE WITH MOVABLE AND FIXED CAMS

[75] Inventors: Kazuyoshi Ohshima; Yojiro Nakayama, both of Tokyo, Japan

[73] Assignee: Sugatsune Industrial Co., Ltd., Tokyo, Japan

[21] Appl. No.: 595,371

[22] Filed: Oct. 10, 1990

[30] Foreign Application Priority Data

Oct. 11, 1989 [JP] Japan ..... 1-164716
Oct. 31, 1989 [JP] Japan ..... 1-284550
Oct. 31, 1989 [JP] Japan ..... 1-284551

[51] Int. Cl.[5] ..... E05F 1/08

[52] U.S. Cl. ..... 16/307; 16/330; 16/54; 16/284

[58] Field of Search ..... 16/329, 330, 53, 54, 16/75, 307, 308, 284

[56] References Cited

U.S. PATENT DOCUMENTS

| | | | |
|---|---|---|---|
| 931,810 | 8/1909 | Tapling | 16/329 |
| 1,078,002 | 11/1913 | Schrey | 16/330 |
| 2,097,651 | 11/1937 | Stangeland | 16/330 |
| 2,230,661 | 2/1941 | Wennmann | 16/307 |
| 3,118,167 | 1/1964 | Morris et al. | 16/54 |
| 3,518,716 | 7/1970 | Larson | 16/284 |
| 4,829,628 | 5/1989 | Vuksic | 16/54 |

*Primary Examiner*—Lowell A. Larson

*Assistant Examiner*—Michael J. McKeon

*Attorney, Agent, or Firm*—Fleit, Jacobson, Cohn, Price, Holman & Stern

[57] ABSTRACT

According to the invention, there is provided a door hinge comprising a spring that plays the role of both a torsion spring and a compression spring, wherein its resilient force is used for axially pressing a movable cam against a matching fixed cam it comprises and thereby facilitating the opening and closing motion of the door with which it is used by giving said cams such specific configurations that the spring accelerates the opening motion of the door from a given angular position of the door and locks the door at a particular open position and at a closed position. Since a door using such a hinge that comprises a spring whose resilient force constantly biases the door to open can be either opened to any desired angle or closed and sustained there under a locked condition when the rotary shaft of the hinge is firmly connected to the door, it can be used for a flap door or another vertically rotatable door such as a toilet lid to sustain the door to an open position under a locked condition even if the resilient force of the spring is nullified at that position and the door is liable to be pushed back by an obstacle such as a wire located behind the toilet assembly comprising the lid. Therefore, the door is protected against any turning effort and other forces which are unintentionally applied to the door.

2 Claims, 11 Drawing Sheets

DOOR HINGE WITH MOVABLE AND FIXED CAMS

BACKGROUND OF THE INVENTION

1. Field of Invention

This invention relates to a hinge to be used for a door such as an ordinary swing door that turns around a set of hinges, a flap door including a vertically pivoting flap door typically used for a toilet lid or the like.

2. Prior Art

There have been known hinges for doors of the type that utilizes a viscous fluid such as polyisobutylene or a similar high molecular viscous fluid substance in combination with a spring in order to obtain a high resistivity against any flinging motion of the doors in the direction through the use of the viscous shearing resistance of the former and the torsional resistance of the latter and induce a smooth and easy rotary movement for opening in the other direction through the effect of the spring.

However, with a door hinge of the type as described above where the resilient force of the spring of the hinge is used to bias the door only in the direction of opening the door around a rotary shaft, it can become very heavy when it is being closed since the hinge of a flap door is so designed that the spring force is utilized to facilitate the opening motion of the door, which is then locked at its open position. In order to make a door provided with such a hinge to be closed without difficulty, the hinge may require an additional mechanism which in turn makes the overall hinge structure a very complicated one.

It is therefore an object of the present invention to provide a door hinge which is free from the above described disadvantage of a conventional one. More specifically, a first object of the invention is to provide a door hinge comprising a spring that plays the role of both a torsion spring and a compression spring, wherein its resilient force is used for axially pressing a movable cam against a matching fixed cam it comprises and thereby facilitating the opening and closing motion of the door with which it is used by giving said cams such specific configurations that the spring accelerates the opening motion of the door from a given angular position of the door and locks the door at a particular open position and at a closed position.

A second object of the invention is to provide a door hinge which is, in addition to the features as described above with reference to the first object of the invention, provided with a damping capability and a function of generating a torque to accelerate the opening motion of the door with which it is used from a particular angular position of the door over a relatively wide range and holding the door open to a particular angular position.

A third object of the invention is to provide a door hinge which is provided with not only a damping capability but a function of generating a torque to accelerate the opening motion of the door with which it is used in the initial stages of the opening motion up to a given angle and that of generating a resistance against closure of the door which is increased as the door approaches the closed position so that the door may be closed smoothly and softly.

SUMMARY OF THE INVENTION

According to a first aspect of the invention, the above described first object of the invention is achieved by providing a hinge that comprises a fixed cam and a movable cam disposed within a casing, said cam being so arranged that it rotates with a rotary shaft to be rotated by a swinging motion of a door fitted thereto and is axially slidable, a spring being provided in such a manner that it stores a resilient force in it when it is twisted in a direction by the rotation of said rotary shaft to rotate back the rotary shaft in the other direction and that it constantly and axially presses said movable cam against the fixed cam for mutual engagement of said fixed and movable cams at a relative angular position of the cams so that said rotary shaft can be locked at a maximum angular position and a minimum angular position within a given range of rotation of said rotary shaft.

According to a second aspect of the invention, the above described second object of the invention is achieved by providing a hinge that comprises a pair of movable members arranged within a casing for being rotated with a rotary shaft to be rigidly fitted to a swing door, the space between said movable members being filled with a viscous fluid, said hinge further comprising a spring carrier so arranged between said rotary shaft and said movable members that it can be engaged with and disengaged from said movable members by means of a spring one-way clutch for being rotated with said movable members only in one direction, said hinge further comprising a movable cam so arranged as to be rotatable with and axially slidable relative to said rotary shaft and a fixed cam so arranged as to be capable of being engaged with said movable cam, a spring being disposed between said spring carrier and said movable cam within said housing, an end of said spring being held by said spring carrier and the other end being axially slidably hooked to said casing, said movable and fixed cams being so configured that a torque is generated within the hinge to rotate the rotary shaft in one direction within a given range of rotation or the rotary shaft by the axial compressive force of the spring.

According to a third aspect of the invention, the above described third object of the invention is achieved by providing a hinge that comprises a pair of movable members arranged within a casing for being rotated with a rotary shaft to be rigidly fitted to a swing door, the space between said movable members being filled with a viscous fluid, said hinge further comprising a spring carrier so arranged between said rotary shaft and said movable members that it can be engaged with and disengaged from said movable members by means of a spring one-way clutch for being rotated with said movable members only in one direction, said hinge further comprising a movable cam so arranged as to be rotatable with and axially slidable relative to said rotary shaft and a fixed cam so arranged as to be capable of being engaged with said movable cam, a spring being disposed between said spring carrier and said movable cam within said housing, an end of said spring being held by said spring carrier and the other end being axially slidably hooked to said casing, said movable and fixed cams being so configured that a torque is generated within the hinge to rotate the rotary shaft in the direction of opening the door in the initial stage of the opening operation of the door within a given range of rotation of the rotary shaft.

With a hinge as described above by referring to the first aspect of the invention, obviously any external force applied to the door to which it is fitted serves as a rotary force for rotating the rotary shaft of the hinge either in the direction of opening or in the direction of closure of the door. As the rotary shaft is rotated along with a movable cam with which it is engaged, the coil spring fitted thereto is twisted to generate a torque for turning back the door in the other direction.

Assuming, for instance, that a flap door provided with a hinge according to the first aspect of the invention rotates between a 0° angular position, or closed position, and a 110° angular position, or fully closed position and that, when it rotates with the rotary shaft of the hinge for closure, it twists the spring in the hinge to store a torsion, the spring naturally accelerates the opening motion of the door to make the user feel easy to open the door.

Since the spring is also utilized as a compression spring that presses the movable cam against the fixed cam and the movable cam is provided with a number of ribs each having an inclined side wall while the fixed cam is provided with the same number of grooves each having a matching inclined side wall, the movable cam eventually comes to be engaged with the fixed cam as the former is rotated until its ribs are located on the respective inclined sides walls of the grooves of the fixed cam so that the door is locked to its maximum angular position (110° angular position).

Therefore, if the door is opened to an intermediary angular position (e.g. 100° angular position) which is close to the maximum angular position (110° angular position), where the ribs of the fixed cams are already located on the respective inclined side walls of the grooves of the fixed cam, the movable cam is inevitably rotated further until it is completely engaged with the fixed cam because of its sliding motion on the inclined side wall and the door is locked to that angular position to prevent any accidental or unintentional closing motion of the door.

In other words, the fixed and movable cams of the hinge are so configured that a torque is generated to further open the door once the door is opened to a given angular position.

The performance of the hinge may be altered by modifying the configuration of the fixed and movable cams so that the door to which the hinge is fitted may be locked to a different angular position or to a fully closed position.

Now, with a hinge as described above by referring to the second aspect of the invention, obviously any external force applied to the door to which it is fitted serves as a rotary force for rotating the rotary shaft of the hinge either in the direction of opening or in the direction of closure of the door. Since the spring carrier with which the rotary shaft is engaged may be engaged with or disengaged from movable members by means of a spring one-way clutch depending on the direction of rotation, the movable members do not rotate with the rotary shaft and the spring carrier when they rotate in a given direction and therefore no viscous shearing resistance is generated within the viscous fluid contained in the hinge.

Assuming, for instance, that a flap door provided with a hinge according to the first aspect of the invention rotates between a 0° angular position, or closed position, and a 110° angular position, or fully closed position and that, when it rotates with the rotary shaft and the spring carrier closure, it twists the spring in the hinge to store a torsion, the resilient force of the spring naturally accelerates the opening motion of the door to make the user feel easy to open the door.

Since the spring carrier and the movable members comes to mutual engagement by means of the spring one-way clutch at this stage, they are rotated with the rotary shaft and the spring carrier to generate viscous shearing resistance in the viscous fluid contained between the movable members and the casing of the hinge so that the hinge operates as a damper that resists the rotation of the rotary shaft.

Consequently, thanks to the resilient force of the spring and the viscous shearing resistance of the viscous fluid, the door will be closed smoothly and softly.

Since the spring is also utilized as a compression spring that presses the movable cam against the fixed cam, a torque is generated within the hinge to accelerate the opening motion of the door when the door is opened to a predetermined angular position (e.g. 55° angular position) so that the movable cam comes to be engaged with the fixed cam as the former is rotated until the door reaches its maximum angular position (110° angular position), where it is locked.

The performance of the hinge may be altered by modifying the configuration of the fixed and movable cams so that the door to which the hinge is fitted may be locked to a different angular position or to a fully closed position.

While a hinge according to the third aspect of the invention operates like a hinge as described above by referring to the second aspect of the invention, it differs from the preceding one in the following points.

The fixed cam and the movableble cam of the hinge are so configured that, as the door to which it is fitted comes close to its fully closed position, the door is subjected to a torque generated by a spring that tries to move the door in the other direction. Consequently the door is closed softly and smoothly.

When the door is fully closed and then opened slightly, the spring operates as a compression spring that presses the movable cam against the fixed cam so that the rotary shaft is subjected to a torque that accelerates the opening motion of the door in the initial stages of the opening operation to make the user feel easy to open it.

Now the present invention will be described in greater detail by referring to the accompanying drawings that illustrate preferred embodiment of the invention.

BRIEF DESCRIPTION OF THE DRAWINGS

Of FIGS. 1 through 7 showing a first embodiment of the hinge of the invention.

Of FIGS. 8 through 12 showing a second embodiment of the door hinge of the invention.

Of FIGS. 13 through 17 showing a third embodiment of the door hinge of the invention.

DETAILED DESCRIPTION OF THE INVENTION

FIGS. 1 through 7 illustrate a first embodiment of the invention.

Figure 1:
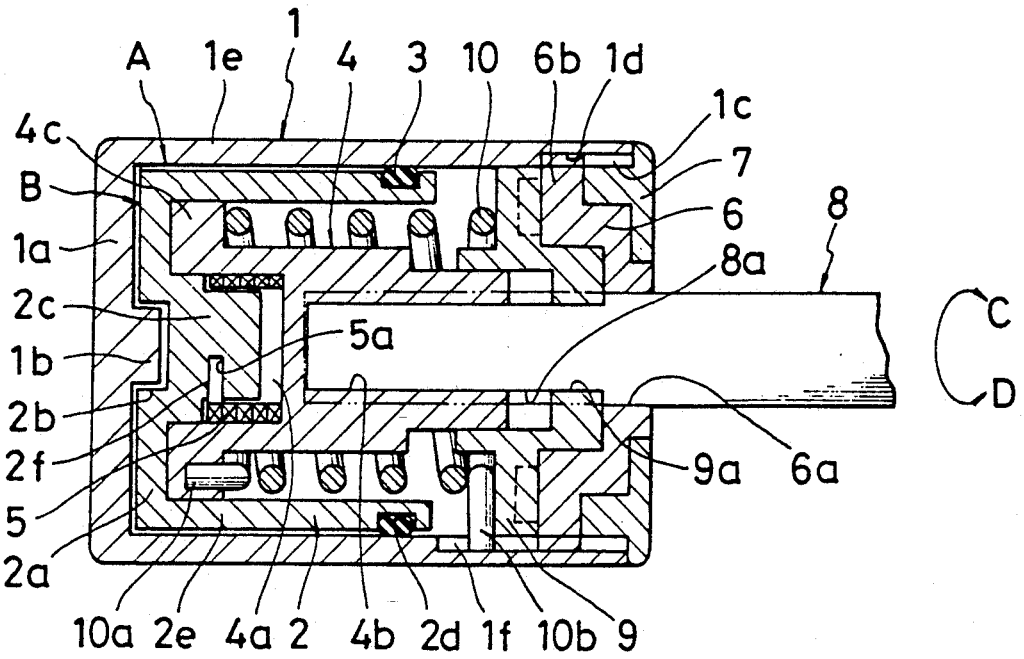
FIG. 1 is a longitudinal sectional view of the embodiment when it is locked.
Figure 2:
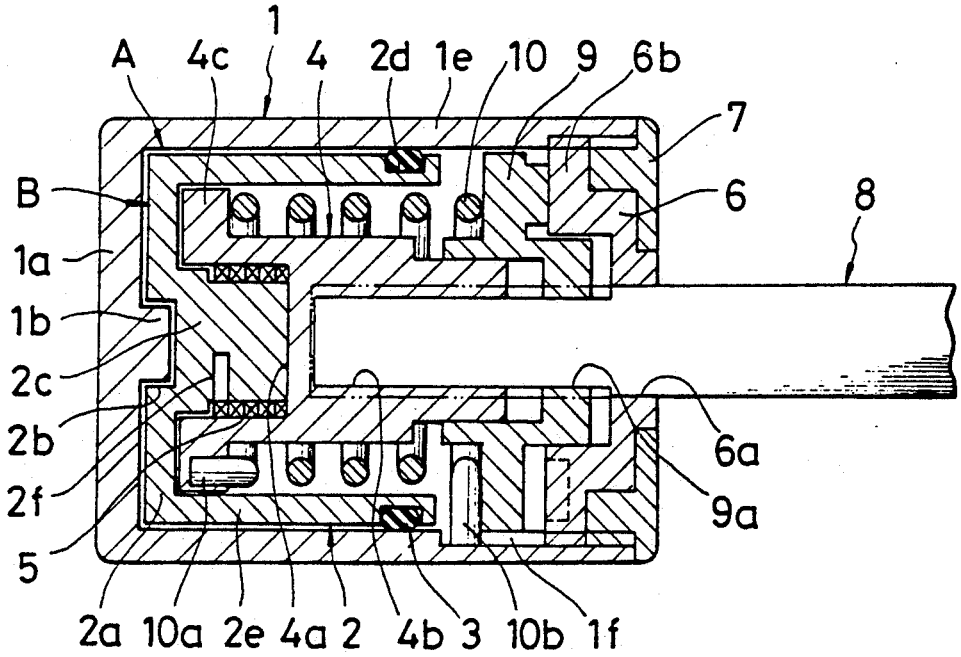
FIG. 2 is a longitudinal sectional view of the embodiment when it is released from the locked condition.
Figure 3:
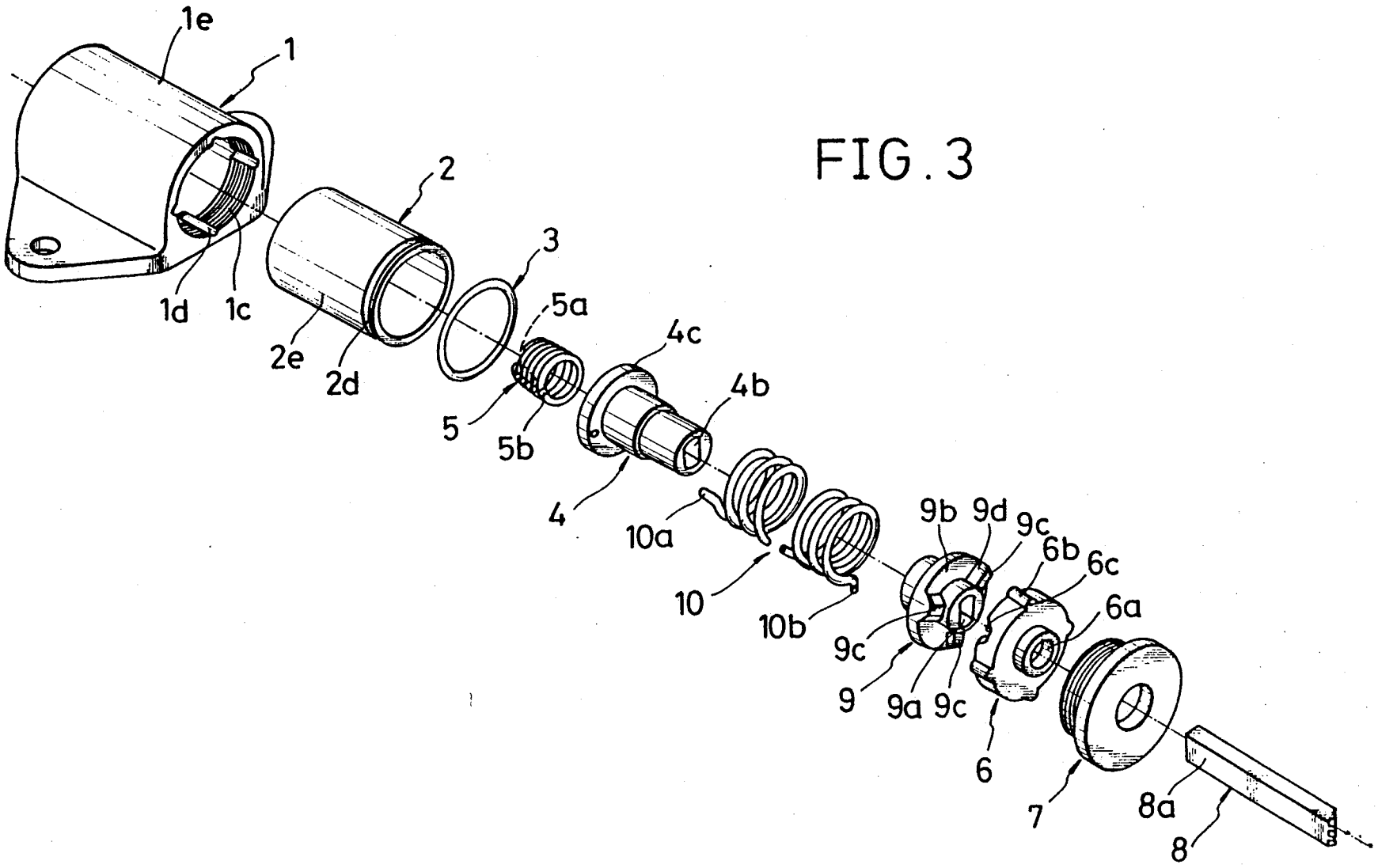
FIG. 3 is an exploded perspective view of the embodiment.

As seen from FIGS. 1 through 3, horizontally placed cylindrical casing 1 comprises a projection 1*b* inwardly extended from the center of the inner surface of its end wall 1*a* and a threaded section 1*c* arranged at the inner periphery of its other end as well as a plurality of longitudinal grooves 1*d* . . . crossing said threaded section 1*c*.

Horizontally placed cylindrical and movable shell 2 has a length which is approximately a half of the effective length of the inside of said casing 1 and an outer diameter which is slightly smaller than the inner diameter of the casing. Its end wall 2*a* is provided at the center of its outer surface with a bore 2*b* for receiving said projection 1*b* and on the outer periphery near its open end with a circular groove 2*d* for receiving a O-ring 3 so that the casing 1 and the movable shell 2 are axially rotatable relative to each other and the space A between them is airtightly sealed by the ring 3.

The space A is thus defined by the end wall 1*a* and the peripheral wall 1*e* of the casing 1 and the end wall 2*a* and the peripheral wall 2*e* of the movable shell 2 and contains in it viscous fluid B that can be a high molecular viscous fluid such as polyisobutylene, pitch or highly viscous water glass.

Horizontally placed cylindrical spring carrier 4 comprises along its axis a cylindrical recess 4*a* and a polygonal hole 4*b* arranged side by side as well as a flange 4*c* on its outer periphery outwardly and radially projection from the end closer to the recess 4*a*. Said spring carrier 4 is so arranged within said movable shell 2 that it is rotatable around the axis of the casing 1 by means of a spring one-way clutch 5 disposed between the recess 4*a* and the projection 2*c* of the movable shell 2.

Said spring one-way clutch 5 is realized by winding a highly resilient steel wire having a rectangular or circular cross section to form a densely wound coil which presses itself against the inner peripheral surface of the recess 4*a* of said spring carrier 4, an end 5*a* of said clutch 5 being projecting perpendicularly relative to its axis and received by a recess 2*f* formed on the projection 2*c* of the movable shell 2, the other end 5*b* being left free within the space provided for the clutch 5.

The fixed cam 6 has a disc-like form with a considerable thickness and is provided with an axial through bore 6*a* and a plurality of axially extending ribs 6*b* . . . arranged on its outer periphery and received by the respective grooves 1*d* . . . of the casing for engagement, said fixed cam being securely held by a lid plate 7 which is screwed into the threaded section 1*c* of the casing 1 so that it is not axially movable nor rotatable around its axis.

Figure 4A:
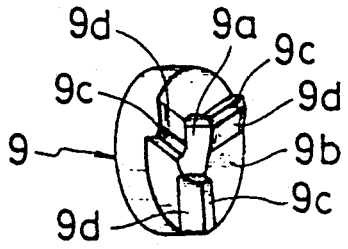
FIGS. 4(*a*) and (*b*) are perspective views respectively showing the movable cam and the fixed cam of the embodiment.
Figure 4B:
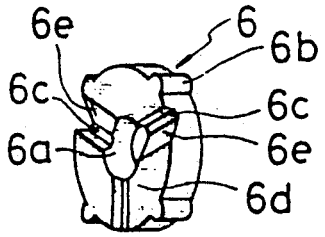
Figure 5A:
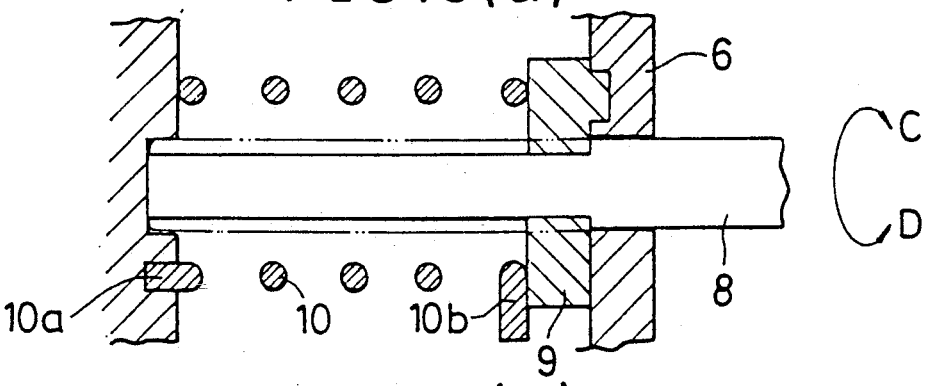
FIGS. 5(*a*) and (*b*) are longitudinal sectional views showing the positional relationship among the fixed cam, the movable cam, the spring and the rotary shaft respectively when the embodiment is locked and when it is unlocked.
Figure 5B:
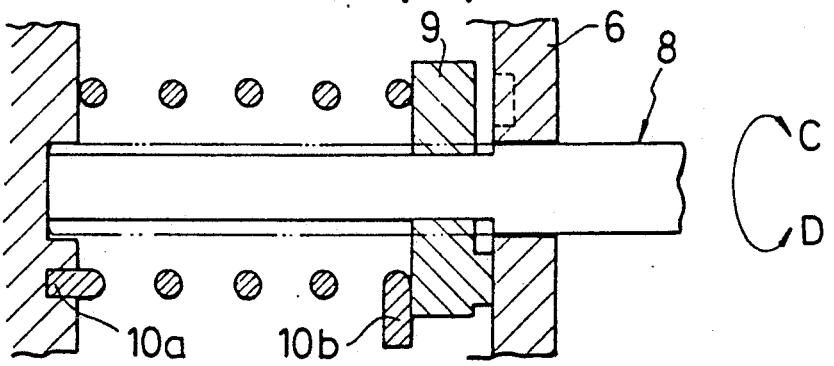

As shown in FIGS. 4(*b*), 6(*a*), 6(*b*) and 6(*c*), said fixed cam 6 is provided with three radially extending grooves 6*c* . . . arranged on its inner end surface 6*d* and equally spaced apart from one another, each of said grooves 6*c* . . . having an inclined side wall 6*e* between the inner end surface 6*d* of the cam 6 and the bottom of the groove.

The rotary shaft 8 runs through the through bore 6*a* of the fixed cam 6 so that it is rotatable around the axis of the casing 1.

Said rotary shaft 8 has a polygonal extension 8*a*, the end of which is received by the matching polygonal hole 4*b* of the spring carrier 4 for being tightly engaged therewith.

As shown in FIGS. 3, 4(*a*), 6(*a*), 6(*b*) and 6(*c*), the movable cam 9 also has a disc-like form with a considerable thickness and is provided with an axial and polygonal through bore 9*a* and three radially extending ribs 9*c* . . . arranged on an end surface 9*b* and equally spaced apart from one another, said ribs being engaged with the corresponding respective grooves 6*c* . . . of the fixed cam 6.

More specifically, each of the ribs 9*c* of the movable cam 9 has an inclined side wall 9*d* that matches the inclined side wall 6*e* of the fixed cam 6.

The movable cam 9 is so arranged around said polygonal extension 8*a* of the rotary shaft 8 within the casing 1 and between the spring carrier 4 and the fixed cam 6 that it is no freely rotatable around the axis of the casing but axially slidable relative to the rotary shaft 8. In other words, as the movable cam 9 rotates with the rotary shaft 8, its ribs 9*c* . . . come into engagement with the corresponding respective grooves 6c. . . and then disengaged therefrom.

The spring 10 is located within said casing 1 with its ends respectively abutting the flange 4c of the spring carrier 4 and a surface of said movable cam 9.

As illustrated, the spring 10 is a coil spring which is so designed that it biases the rotary shaft 8 in one direction, resists any rotary movement of the shaft 8 in the other direction and at the same time press the movable cam 9 against the fixed cam 6. Therefore, when the spring 10 is not compressed, it has a length significantly greater than the distance between the flange 4c of the spring carrier 4 and the spring receiving surface of the movable cam 9. As mentioned earlier, an end 10a of said spring 10 is received by the flange 4c of the spring 4, while its other end 10b is slidably received by an axially extending groove 1f formed on the inner periphery 1e of the casing 1. The spring 10 may be forcibly twisted before its ends 10a and 10b are received by the respective receiving members so that the rotary shaft 8 is angularly biased by the spring by a certain angle from the angle of reference, or angle 0°.

The portion of the rotary shaft 8 which is projecting from the casing 1 is rigidly connected to the center of rotation of a door or a similar item (not shown) so that an external turning effort is applied thereto.

As the rotary shaft 8 and the spring carrier 4 are rotated in one direction or the direction indicated by arrow C in FIG. 1, the spring one-way clutch 5 comes to closely contact with the inner peripheral surface of the recess 4a of the spring carrier 4 until the movable shell 2 is connected and rotates with the rotary shaft 8 and the spring carrier 4.

When, on the contrary, the rotary shaft 8 and the spring carrier 4 are rotated in the other direction or the direction indicated by arrow D in FIG. 1, the spring one-way clutch 5 comes to slide on the inner peripheral surface of the recess 4a so that it is eventually disconnected from the rotary shaft 8 and the spring carrier 4.

In short, the spring one-way clutch 5 plays the role of sustaining or disrupting the power transmission path constituted by the rotary shaft 8, the spring carrier 4 and the movable shell 2 depending on the direction of rotation of the rotary shaft 8 and the spring carrier 4.

Figure 7:
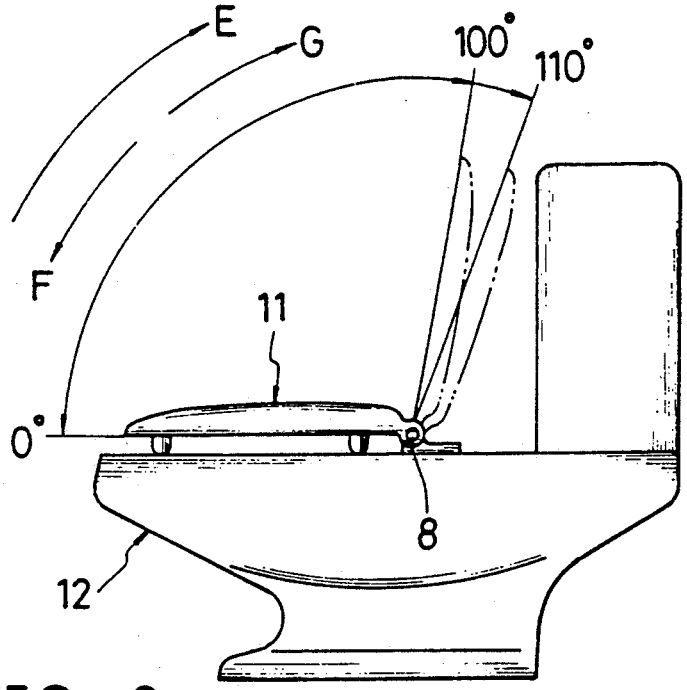
FIG. 7 is a side view of a toilet assembly incorporating the embodiment of the invention.

When a hinge having a configuration as described above is used for a toilet seat and a toilet lid as illustrated in FIG. 1 or a flat door (not shown), the rotary shaft 8 is connected to the toilet seat 11 and the casing is fitted to a toilet seat holding member, or a toilet bowl 12, in such a manner that the toilet seat 11 can be pivoted by an angle greater than 90° betweenits horizontal closed position, or angle 0° position, and its wide open position, or angle 110° position, as illustrated in FIG. 7. It should be noted that the opening movement of the toilet lid corresponds to the rotation of the rotary shaft 8 in the direction indicated by arrow D in FIG. 1.

When the toilet seat 11 is opened from its angle 0° position and the rotary shaft 8 is rotated in the direction of arrow 0, the spring carrier 4 is also rotated in the direction of arrow D due to the fact that it is engaged with the rotary shaft 8, that the spring carrier 4 is biased in the direction of arrow D by the spring 10 and that the rotary shaft 8 is subjected to the resilient force of the spring 10 in the direction of arrow D by way of the spring carrier 4. The rotation of the spring carrier 4 results in reduction of the diameter of the spring one-way clutch 5, which in turn releases the tight connection of the spring one-way clutch 5 and the spring carrier 4 so that the connection between the spring carrier 4 and the movable shell 2 is also released to produce a clutch "disconnected" condition, where only the rotary shaft 8 and the spring carrier 4 are rotated in the direction of arrow D while the movable shell 2 is not rotated and therefore the shearing resistance of the viscous fluid B remains inoperative.

Figures 6A, 6B, 6C:
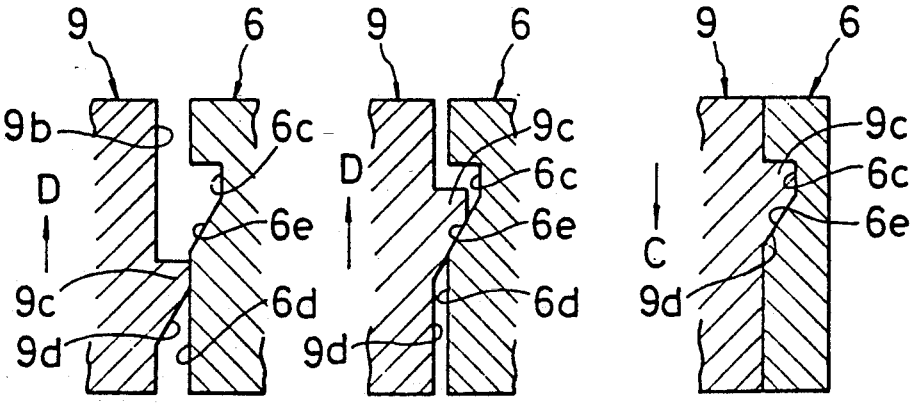
FIGS. 6(*a*), (*b*) and (*c*) are radial sectional views showing the engagement between the fixed cam and the movable cam under three different positional conditions.

While the movable cam 9 is rotated with the rotary shaft 8 in the direction of arrow D because of their mutual engagement, the front ends of the ribs 9c. . . are pressed against the surface 6d of the fixed cam 6 under a condition as illustrated in FIG. 6(a).

As the rotary shaft 8 is further rotated in the direction of arrow D by the opening motion of the toilet seat 11 until the latter reaches the angle 100° position as illustrated in FIG. 7, the ribs 9c . . . of the movable cam 9 move to the corresponding inclined side walls 6e . . . of the fixed cam 6. Under this condition, a torque is generated within the system to accelerate the opening motion of the toilet seat 11 because of the resilient force of the spring 10 trying to bias the movable cam 9 toward the fixed cam so that said ribs 9c are guided into the respective grooves 6c . . . along the inclined side walls 6e . . . until said ribs 9c . . . are completely received by the respective grooves 6c . . . and therefore the movable cam 9 is securely engaged with the fixed cam to lock the toilet seat 11 (rotary shaft) to its open position (angle 110° position).

When, to the contrary, the toilet seat 11 is closed and the rotary shaft 8 is rotated in the direction of arrow C of FIG. 1 along with the spring carrier 4, the spring one-way clutch 5 comes to tightly contact with the inner peripheral surface of the recess 4a of the spring carrier 4 to connect the movable shell 2 with the spring carrier 4 and the rotary shaft 8 so that the movable shell 2 is rotated with the rotary shaft 8 to generate a viscous shearing resistance in the viscous fluid B that resists the rotary movement of the rotary shaft 8.

Since, at this stage, the coil spring 10 is twisted further by the rotation of the spring carrier 4, it exerts a resistance against the rotary movement of the rotary shaft 8 to slow down the closing action of the toilet seat 11 until it smoothly and softly reaches the closed position, or angle 0° position.

Moreover, since the movable cam 9 is rotated in the direction of arrow C of FIG. 1 with the rotary shaft 8 from the position as indicated in FIG. 6(C), the ribs 9c . . . of the movable cam 9 climb up the respective inclined side walls 6e . . . of the grooves 6c . . . against the resilient force of the spring 10 until they get to the surface 6d of the fixed cam 6 to release the toilet seat 11 from the open and locked condition.

Arrow E in FIG. 7 indicates the direction in which the resilient force of the spring 10 is applied to the rotary shaft 8 and therefore the toilet seat 11 and arrow F indicates the direction of viscous shearing resistance of the viscous fluid B, whereas arrow G shows the direction where no viscous shearing resistance is traced.

FIGS. 8 through 12 illustrate a second embodiment of the invention.

As seen from FIGS. 8 through 12, casing 1 comprises a cylindrical projection 1g standing from the center of its end 1a, an axial bore 1h being formed along the axis of said cylindrical projection 1g.

Rotary shaft 8 runs through the axial through bore 6a of a fixed cam 6 which is rigidly held by the casing 1 so that the rotary shaft 8 and the casing 1 are concentric relative to each other.

An extension of said rotary shaft 8 which is found within the casing 1 is roratably received by the axial bore 1*h* and the portion of said extension between the outer end of the cylindrical projection 1*g* and the movable cam 6 forms a polygonal section 8*a*, a movable cam 9 being arranged around said polygonal section 8*a* in such a manner that it is axially slidable relative to the rotary shaft 8 and rotatable around axis of rotation of the rotary shaft 8 with the latter.

Figure 8:
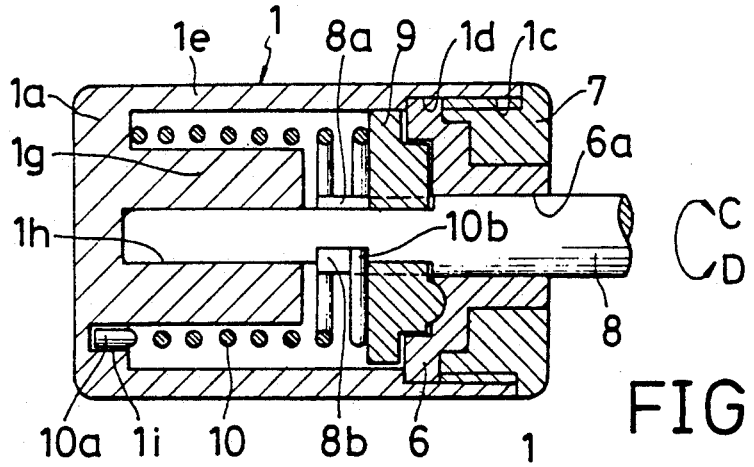
FIG. 8 is a longitudinal sectional view of the embodiment when it is locked.
Figure 9:
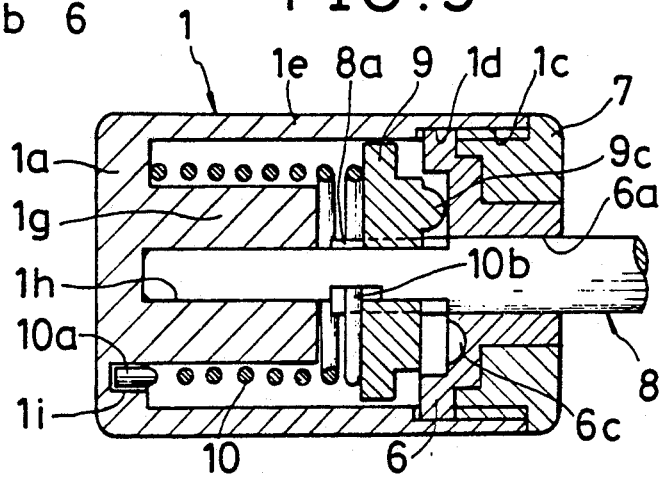
FIG. 9 is a longitudinal sectional view of the embodiment when it is released from the locked condition.
Figure 10A:
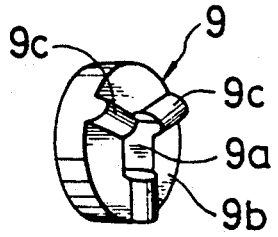
FIGS. 10(*a*) and (*b*) are perspective views respectively showing the movable cam and the fixed cam of the embodiment.
Figure 10B:
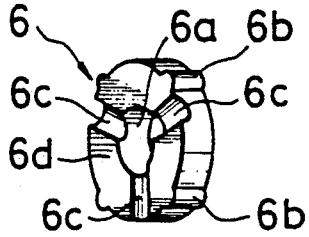

A spring 10 is arranged within the casing 1 between the inner surface of the end 1*a* and the inner surface of the movable cam 9, its one end 10*a* being bent to form a hook and held within a recess 1*i* formed on said end 1*a*, its other end 10*b* being received by an axial groove 8*b* formed on said movable cam 9 so that it is slidable only in the axial direction and therefore said spring 10 may be twisted further when the rotary shaft 8 is rotated in the direction of arrow C in FIG. 8.

The effective length of said spring 10 is so selected that it is longer than the distance between the inner surface of the end 1*a* of the casing 1 and the inner surface of the movable cam 9 and therefore the movable cam 9 is constantly biased toward the fixed cam 6 by the spring 10.

The fixed cam 6 has on its surface facing the movable cam 9 three radial grooves 6*e*... which are spaced apart from one another by a same angle, or 180°, and has a substantially semicircular cross section, while the movable cam 9 is provided with three corresponding radial ribs 9*c*... which are also equally spaced apart from one another and has a substantially semicircular cross section so that they may be engaged with and disengaged from the respective grooves 6*e*....

It should be noted that, unlike the first embodiment, this second embodiment is not provided with a movable shell 2, nor with a spring carrier 4 and therefore not with a viscous fluid B.

Figure 12:
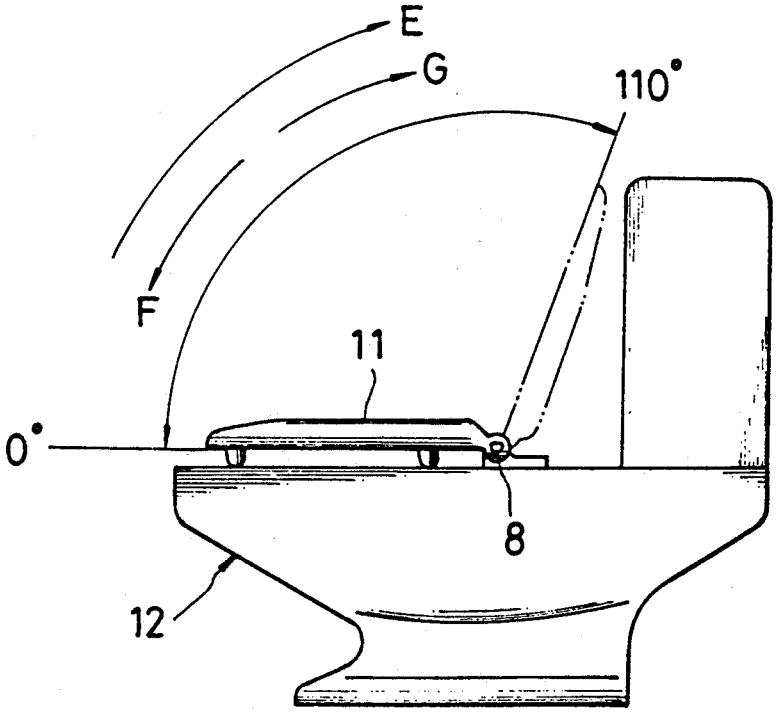
FIG. 12 is a side view of a toilet assembly incorporating the embodiment of the invention.
Figure 13:
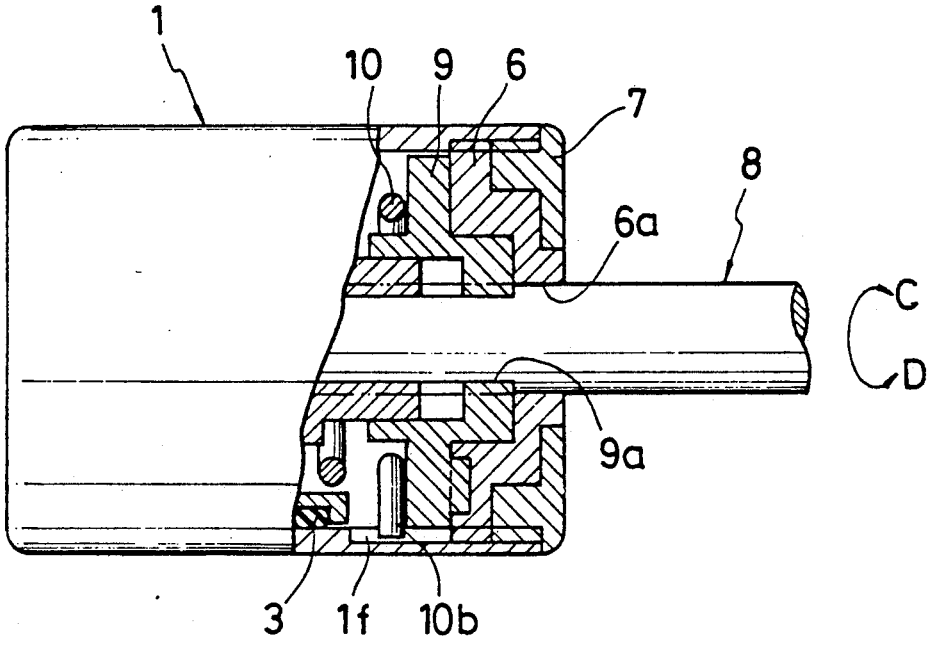
FIG. 13 is a partially sectional side view of the embodiment when it is locked.
Figure 14:
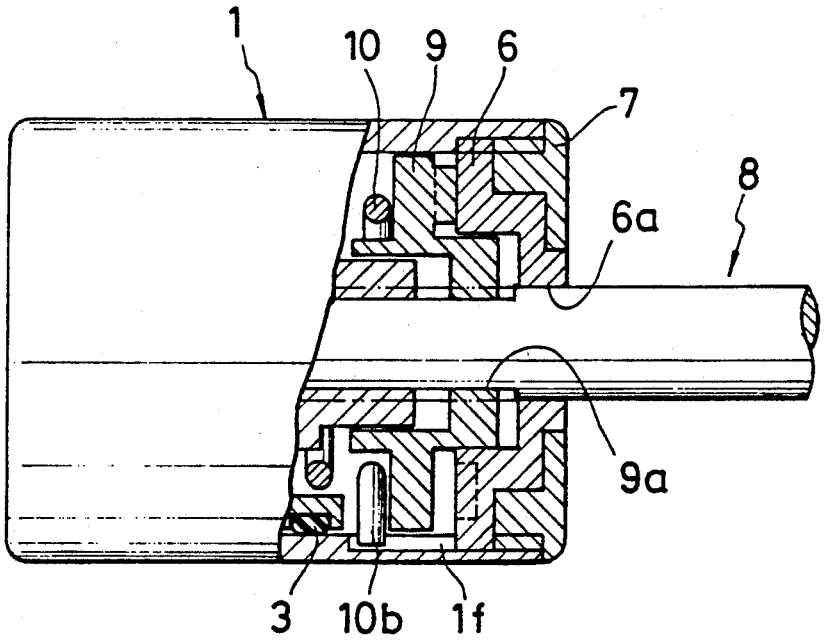
FIG. 14 is a partially sectional side view of the embodiment when it is released from the locked condition.
Figure 15A:
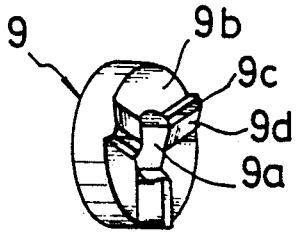
FIGS. 15(*a*) and (*b*) are perspective views respectively showing the movable cam and the fixed cam of the embodiment.
Figure 15B:
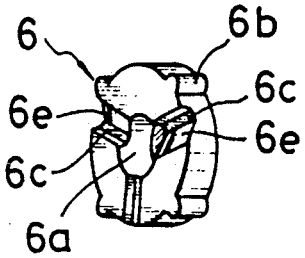

When said second embodiment is used for a toilet seat 11 of a toilet assembly as illustrated in FIG. 12, the rotary shaft 8 is connected to the toilet seat 11 in a manner similar to that of the first embodiment.

Figure 11A:
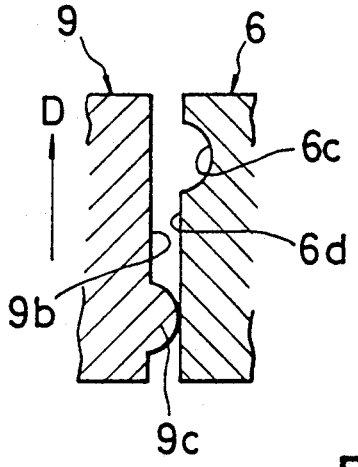
FIGS. 11(*a*) and (*b*) are radial sectional views showing the engagement between the movable cam and the fixed cam under two different positional conditions.
Figure 11B:
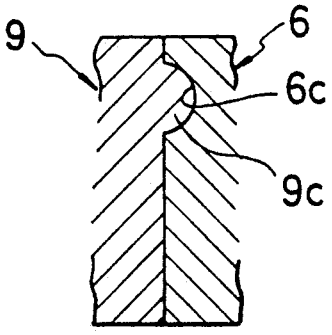

When the toilet seat 11 is opened from its closed position, or angle 0° position, and the rotary shaft 8 is rotated in the direction of arrow D in FIG. 8, the movable cam 9 is rotated with said rotary shaft 8 in that direction because the rotary shaft 8 is biased in the same direction by the spring 10 while the ribs 9*c*... of the movable cam 9 are pressed against the inner surface 6*d* of the fixed cam 6 by the spring 10 as illustrated in FIG. 11(*a*).

As the toilet seat 11 is opened further until it reaches the full open position, or angle 110° position, the ribs 9*c*... of the movable cam 9 are fully received by the respective grooves 6*c*... of the fixed cam 6 for mutual engagement of the movable and fixed cams 6 and 9 and the toilet seat 11 is locked to its position (angle 110° position).

When the toilet seat 11 is closed from the open position, the rotary shaft 8 is rotated in the direction as indicated by arrow C in FIG. 8 and the spring 10 is twisted also in that direction so that the resilient force of the spring 10 resists the rotation of the rotary shaft 8 and consequently the toilet seat 11 is smoothly and softly closed to its fully closed position, or angle 0° position.

At this stage, the ribs 9*c*... of the movable cam 9 are released from the engagement with the respective grooves 6*c* of the fixed cam 6 by the rotary movement of the movable cam 9 in the direction of arrow C against the biasing force of the spring 10 so that the toilet seat 11 is unlocked from its open position.

FIGS. 13 through 17 illustrate a third embodiment of the invention.

In this embodiment, both the fixed cam 6 and the movable cam 9 have a configuration which is different form that of their counterparts 6 and 9 of the first embodiment.

More specifically, the inclined side wall 6*e* of each of the grooves 6*c*... of the fixed cam 6 and the corresponding side wall 9*d* of each of the ribs 9*c*... of the movable cam 9 are found at the side opposite to that of their counterparts 6 and 9 of the first embodiment, although the rest of the configuration of these components are similar to that of their counterparts of the first embodiment.

FIGS. 13 through 17 illustrate a third embodiment of the invention.

This embodiment differs from the first embodiment in that the fixed cam 6 and the movable cam 9 have profiles which are different from those of the fixed and movable cams 6 and 9 of the first embodiment.

In this embodiment, the inclined side wall 6*e* of each of the recesses 6*c*... of the fixed cam 6 and the matching inclined side wall 9*d* of each of the ribs 9*c*... of the movable cam 9 are arranged on the side opposite to that of their counterparts of the first embodiment. Otherwise, this third embodiment is configured similarly as the first embodiment.

Figure 17:
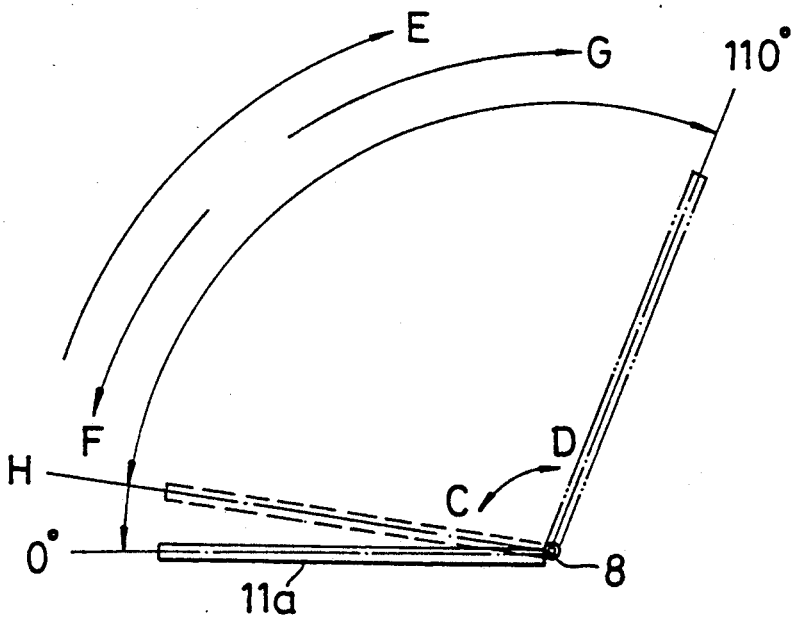
FIG. 17 is a schematic plan view of a door incorporating the third embodiment.

When this embodiment is used for an ordinary swing door 11*a* as illustrated in FIG. 17, the rotary shaft 8 is connected to the door 11*a* in a manner similar to that of the first embodiment.

When the door 11*a* is turned open from its angle 0° position in a direction as indicated by arrow D, the rotary shaft 8 is rotated with the movable cam 9 also in the direction of arrow D until the door 11*a* reaches the full open position, or angle 110° position because of the resilient force of the spring 10 applied to the rotary shaft 8.

When, to the contrary, the door 11*a* is turned for closure, the rotary shaft 8 is rotated in the direction of arrow C to twist further the spring 10 as in the case of the first embodiment so that the door 11*a* is closed smoothly and softly by the resilient force of the spring and the viscous shearing resistance of the viscous fluid in the hinge assembly that resist any abrupt closing movement of the door 11*a*.

Figures 16A, 16B, 16C:
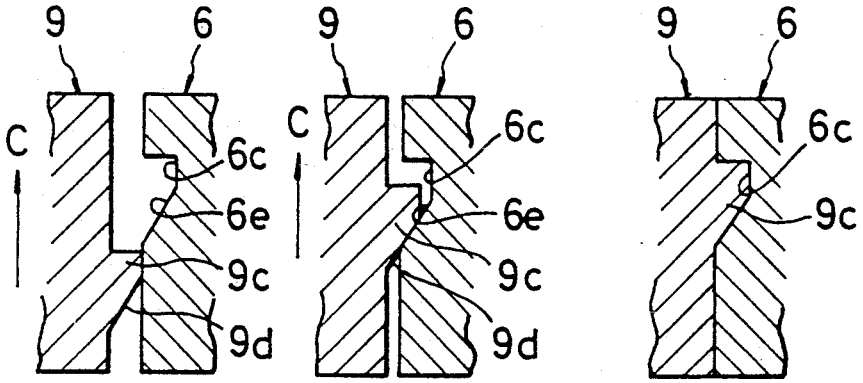
FIGS. 16(*a*), (*b*) and (*c*) are radial sectional views showing the engagement between the movable cam and the fixed cam under three different positional conditions.

As the movable cam 9 is rotated with the rotary shaft 8 in the direction of arrow C and the door 11*a* comes to its fully clcsed angle 0° position or point H in FIG. 17, it is pressed against the inner surface 6*d* of the fixed cam 6 by the spring 10 and the front edges of the ribs 9*c*... of the movable cam 9 move to the respective inclined side walls 6*e*... of the grooves 6*c*... of the fixed cam 6 as illustrated in FIG. 16(*a*). Then, the inclined side walls 9*d*... of the movable cam 9 slide on the respective inclined sides walls 6*e*... of the fixed cam 6 until the ribs 9*c*... of the movable cam 9 comes to be fully engaged with the respective recesses 6*c*... of the fixed cam 6 as shown in FIG. 16(*b*) so that the door 11*a* moves from the point H to the angle 0° position and locked there.

It should be noted that the arrows E, F and G in FIGS. 12 and 17 respectively indicate directions which are same as those indicated by the arrows E, F and G in FIG. 7.

According to a second aspect of the invention, there is provided a hinge having a configuration which is essentially identical with that of the above embodiments but differs from it in the sense as described below.

Like the above embodiments, a hinge according to the second aspect of the invention comprises a relatively thick disc-shaped fixed cam 6 having a central circular axial through bore 6*a* and a plurality of axial ribs 6*b* . . . arranged on its outer peripheral surface, said axial ribs 6 . . . being received by corresponding respective axial grooves 1*d* . . . of a casing 1 and rigidly held there by means of a lid plate 7 which is screwed into the threaded section 1*c* of the casing 1 so that it may not axially move nor rotate. However, as seen from FIGS. 18 and 19, the inner surface 6*d* is realized in the form of an inclined surface 6*e* and a perpendicular wall 6*h* whose height is defined by the highest portion 6*f* and the lowest portion 6*g* of the inclined surface 6*e*.

Figure 18A:
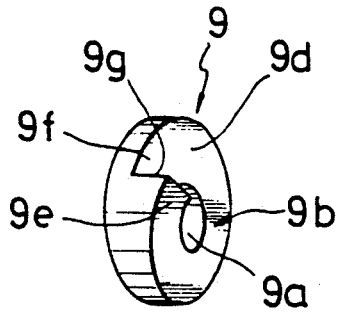
FIGS. 18(*a*) and (*b*) are respectively perspective views of the movable cam and the fixed cam of the second embodiment of the invention.
Figure 18B:
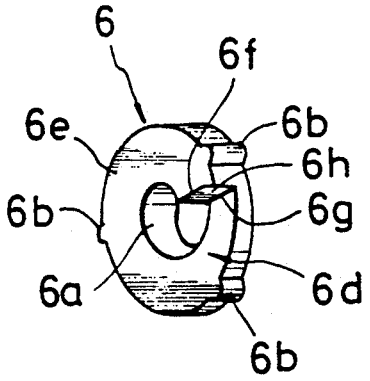

As shown in FIGS. 18(*a*), 19(*a*) and 19(*b*), the hinge also comprises a relatively thick disc-shaped movable cam 9 having a central polygonal axial through bore 9*a* and its outer surface 9*d* is realized in the form of an inclined surface and a perpendicular wall 9*g* that respectively corresponds to the inclined surface 6*e* and the perpendicular wall 6*h* of the fixed cam 6, the height of which is defined by the highest portion 9*e* and the lowest portion 9*f* of the inclined surface 9*d*.

Figure 19A:
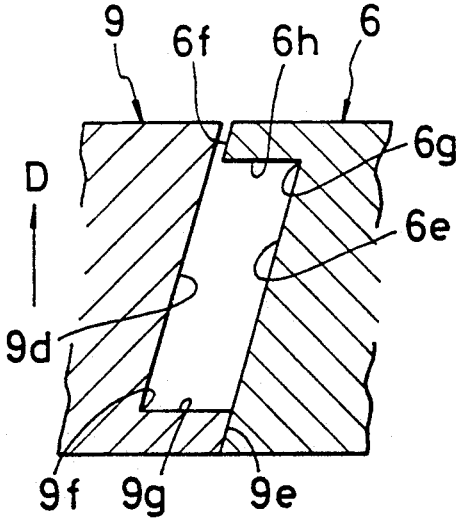
FIGS. 19(*a*) and (*b*) are sectional views showing the engagement of the fixed cam and the movable cam of the second embodiment under two different positional conditions.
Figure 19B:
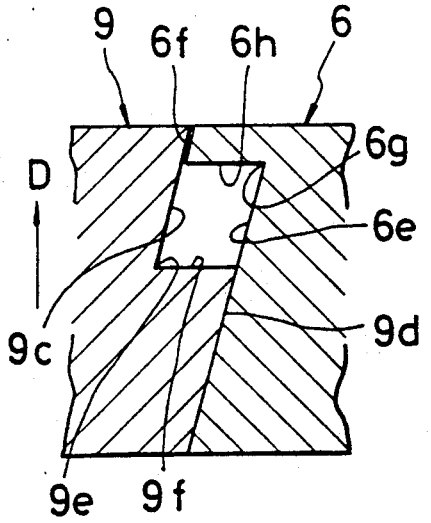

Said movable cam 9 is fitted to polygonal extension 8*a* of a rotary shaft 8 in such a manner that it is axially movable but not peripherally so that it freely rotates with the rotary shaft 8 and may be engaged with or disengaged from the fixed cam 6 as it axially moves as illustrated in FIG. 19(*a*) and (*b*).

A hinge according to the second aspect of the invention operates in the following manner.

Figure 20:
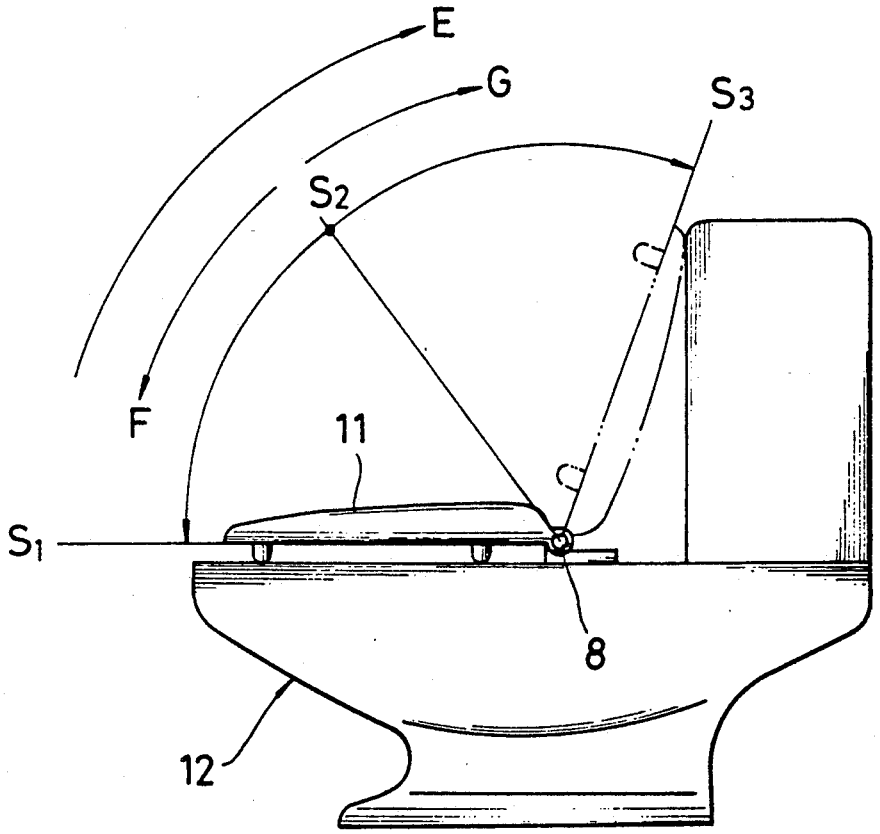
FIG. 20 is a side view of a toilet assembly incorporating the second embodiment.

Referring to FIG. 20, as the toilet seat 11 to which the hinge is applied is rotated from its closed position S1 to a first open position S2 (e.g. opened by 55°), the highest portion 9*e* of the movable cam 9 is moved to the inclined surface 6*e* of the fixed cam 6 as shown in FIG. 19(*a*) and a torque is generated to open the toilet seat 11 because of the effect of the spring 10 as a compression spring and the shape of the two cams 6 and 9 so that the movable cam 9 is rotated in the direction of arrow D of FIG. 19(*b*) through the mutual action of the two inclined surfaces 6*d* and 9*c* until the perpendicular walls 6*h* and 9*g* of the cams 6 and 9 abut each other. Consequently, the toilet seat 11 is opened up to a full open position S3 and locked there.

When, to the contrary, the toilet seat 11 is moved for closure from its full open position, the rotary shaft 8 and the spring carrier 4 are rotated in the direction of arrow C in FIG. 1 and the spring one-way clutch 5 comes to closely contact with the inner peripheral wall of the recess 4*a* of the spring carrier 4 and connect the movable shell 2 with the spring carrier 4 and the rotary shaft 8 so that the movable shell 2 is rotated with the rotary shaft 8 and a viscous shearing resistance is generated in the viscous fluid B to hinder the rotation of the rotary shaft 8.

At this stage, the spring 10 is twisted further by the rotation of the spring carrier 4 and therefore the rotation of the rotary shaft 8 is hindered by the resilient force of the spring 10. As a result, the toilet seat 11 is moved smoothly and softly until it reaches a closed position E.

Then, since the movable cam 9 is rotated with the rotary shaft 8 in the direction of arrow C from the position as shown in FIG. 1, the movable cam 9 and the fixed cam 6 are relatively separated from each other as the movable cam 9 is rotated in such a way that its inclined surface 9*d* climbs up the inclined surface 6*e* of the fixed cam 6. Consequently, the toilet seat 11 comes to open position S3, where it is unlocked.

According to a third aspect of the invention, there is provided a hinge having a configuration which is essentially identical with that of the embodiments described earlier but differs from it in the sense as stated below.

Figure 21A:
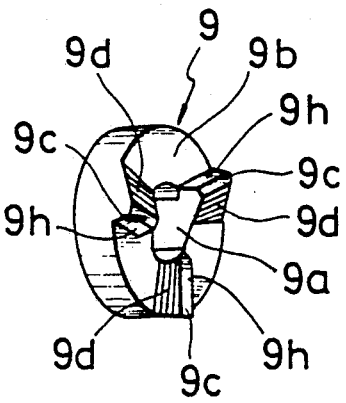
FIGS. 21(*a*) and (*b*) are respectively perspective views of the movable cam and the fixed cam of the third embodiment of the invention.
Figure 21B:
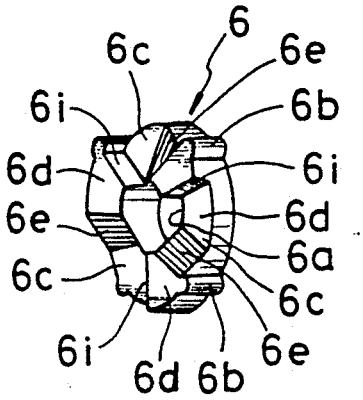

As illustrated in FIGS. 21(*b*) and 22(*a*), a hinge according to the third aspect of the invention comprises a relatively thick disc-shaped fixed cam 6 having three radial grooves 6*c* . . . on its inner surface 6*d* which are equally spaced apart from one another, one of the side walls of each of said grooves 6*c* . . . being formed as an inclined side wall 6*e* stretching from the inner surface 6*d* down to the bottom of the groove 6*c*, the other side wall being a perpendicular side wall 6*i* which is found parallel to the axis of rotation of the hinge.

As seen from FIG. 21(*a*), the movable cam 9 of the hinge is realized in the form of a relatively thick disc having a polygonal central axial through bore 9*a* and three radially extending ribs 9*c* . . . on its outer surface which are equally spaced apart from one another.

Each of the ribs 9*c* . . . has profile that corresponds to that of the groove 6*c* that receives it although the width of the former is a little smaller than that of the groove 6*c* so that the movable cam 9 may be slightly rotated even when the ribs 9*c* . . . are fully engaged with the respective grooves 6*c* . . . .

Each of said ribs 9*c* . . . has an inclined side wall 9*d* that matches the corresponding inclined side wall 6*e* of the fixed cam 6 and a perpendicular side wall 9*h* that also matches the corresponding perpendicular side wall 6*i* of the fixed cam 6.

Figure 22A:
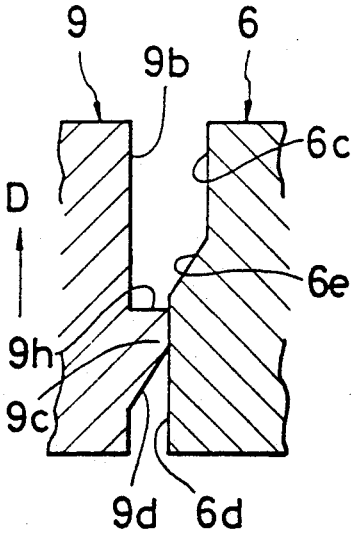
FIGS. 22(*a*), (*b*) and (*c*) are sectional views showing the engagement of the fixed and the movable cam of the third embodiment under three different positional conditions.
Figure 22B:
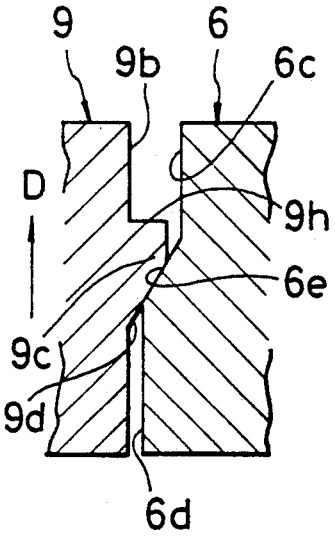
Figure 22C:
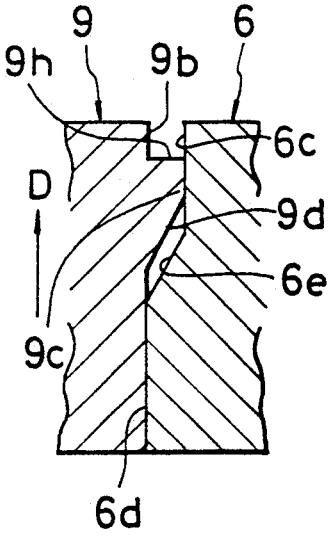

Said movable cam 9 is fitted to an polygonal extension 8*a* of the rotary shaft 8 between the spring carrier 4 and the fixed cam 6 in such a manner that it is axially slidable but peripherally not slidable relative to the rotary shaft 8 and that it is rotatable with the rotary shaft 8 so that it may be engaged with and disengaged from the fixed cam 6 as illustrated in FIGS. 22(*a*) and (*b*).

A hinge according to the third aspect of the invention operates in the following manner.

Figure 23:
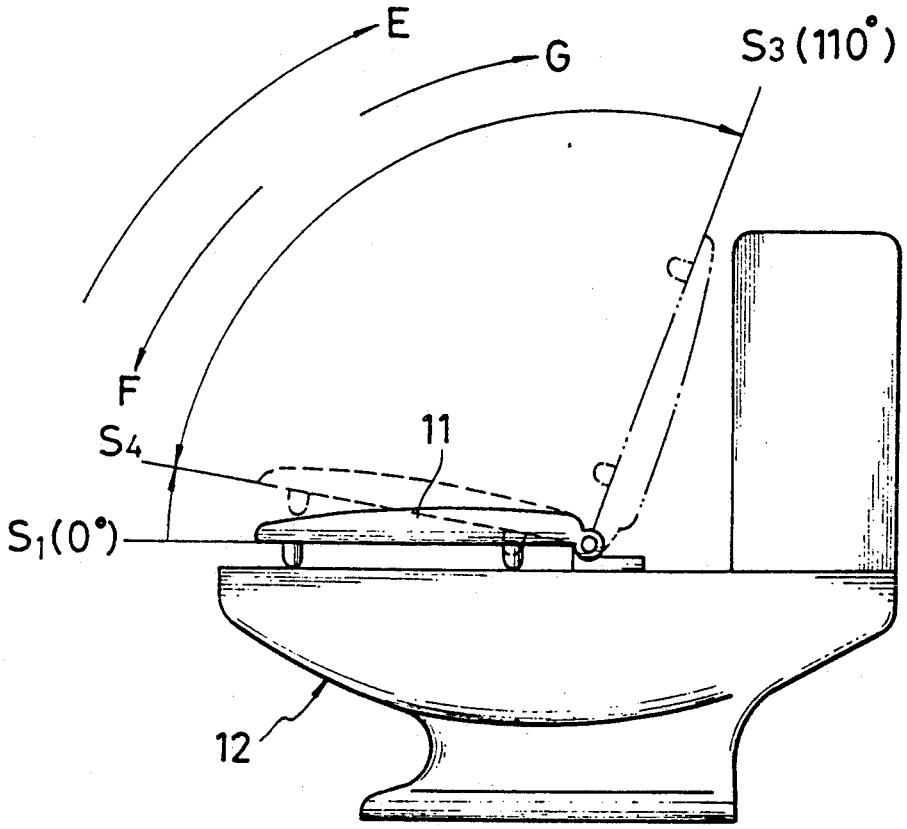
FIG. 23 is a side view of a toilet assembly incorporating the third embodiment.

Referring to FIG. 23, when the toilet seat 11 is slightly moved from its closed position, or position S1, to an open position, or position S4, the ribs 9*c* . . . movable cam 9 come to abut the respective inclined side walls 6*e* . . . of the fixed cam 6 as illustrated in FIG. 22(*b*).

Under this condition, the inclined side walls 9*d* . . . of the movable cam 9 slide down the respective inclined side walls 6*e* . . . of the fixed cam 6 by the axially biasing effect of the spring 10 and consequently the movable cam 9 is rotated in the direction of arrow D.

In other words, a torque is generated within the hinge to turn the rotary shaft 8 and the toilet seat 11, which is therefore moved with ease by a light initial opening effort of the user.

As the toilet seat 11 passes the position S4 illustrated in FIG. 23, the ribs 9*c* of the movable cam 9 come to be engaged with the respective grooves 6*c* . . . of the fixed cam 6 to rotate the cam 6. Consequently, the torque of the hinge is reduced to nil as it is in its closed position S1, although the biasing force of the spring 10 is smaller.

Now, the toilet seat 11 is moved to its open position S3 by the resilient force of the spring 10.

When, to the contrary, the toilet seat 11 is moved from its closed position, the rotary shaft 8 and the spring carrier 4 are rotated in the direction of arrow C of FIG. 1 to bring the spring one-way clutch 5 into a tight contact with the spring carrier 4 so that the movable shell 2 is connected with the spring carrier 4 and the rotary shaft 8 and the movable shell 2 is rotated to generate a viscous shearing resistance within the viscous fluid B that resists the turning effort of the rotary shaft 8.

Since the spring 10 is twisted further by the rotation of the spring carrier 4 at this stage, the resilient force of the spring 10 deters any abrupt motion of the toilet seat 11 so that it is moved smoothly and softly to its closed position S1.

Under this condition, as the movable cam 9 is rotated from the position as shown in FIG. 22(*c*) in the direction of arrow C in FIG. 1 or in the direction opposite to arrow D in FIG. 22(*c*), the movable cam 9 is rotated while its inclined side walls 9*d* . . . climb the respective inclined side walls 6*e* of the fixed cam 6 to the left in FIG. 1 to compress and at the same time shift the spring 10 leftward as seen in FIG. 2.

Consequently, the ribs 9*c* . . . of the movable cam 9 are pressed hard against the inner surface 6*d* of the fixed cam 6 by the spring 10. The pressure of the spring 10 acts as a braking force for the closing movement of the toilet seat 11 at the final stages of its closure. Thus, the toilet seat 11 is smoothly and softly moved from the open position S4 in FIG. 23 to the closed position S1.

As is apparent from the above detailed description of the present invention, since a door using a hinge according to the first aspect of the invention and comprising a spring whose resilient force constantly biases the door to open can be either opened to any desired angle or closed and sustained there under a locked condition when the rotary shaft of the hinge is firmly connected to the door, it can be used for a flap door or another vertically rotatable door such as a toilet lid to sustain the door to an open position under a locked condition even if the resilient force of the spring is nullified at that position and the door is liable to be pushed back by an obstacle such as a wire located behind the toilet assembly comprising the lid. Therefore, the door is protected against any turning effort and other forces which are unintentionally applied to the door and can be kept to an open position, although it can be turned back to the closed position smoothly and softly against the resilient force of the spring it comprises and locked to that position so that any abrupt motion of the door may be eliminated.

Moreover, since the hinge may be so designed that it can generate a torque for both opening and closing the door by altering the profile of the fixed and movable cams, there may be provided, if necessary, a door that can be opened or closed from a certain intermediary position to a fully open or closed position and locked there. Since a single spring can meet all these requirements, the hinge is configured with a very simple structure and therefore can be prepared at a low cost.

A flap door or a toilet lid provided with a hinge according to the second aspect of the invention and having a rotary shaft rigidly connected to the door can be opened to any angular position by the spring it comprises that operates as a torsion spring to that position and thereafter acts as a compression spring for pressing a movable cam against a fixed cam to generate a torque for further opening the door so that the door may be turned smoothly and softly to its fully open position and locked there. Then, the door may be smoothly and softly turned back to its closed position thanks to the torque generated within the hinge for opening the door, the resilient force of the spring and the viscous shearing resistance of the viscous fluid it contains that tend to offset the abrupt closing motion of the door. Since the door may be so designed as to be opened to any desired angular position by altering the profile of the fixed and movable cams, the door may perform any selected action in terms of opening and closing. Moreover, since a single spring is used as both a torsion spring and a compression spring, the hinge is configured with a very simple structure and therefore can be prepared at a low cost.

Since a flap door or a toilet lid using a hinge according to the third aspect of the invention and comprising a spring that operates as a compression spring for constantly biasing a movable cam to a fixed cam it comprises which, if appropriately configured, generate a torque for rotating the rotary shaft in the direction of opening the door, the initial stages of the opening operation of the door are carried out particularly smoothly and softly. Moreover, the closing action of the door is also soft and smooth because the torque for rotating the rotary shaft in the direction of opening the door decelerates the closing motion of the door.

Here again, since a single spring is used as both a torsion spring and a compression spring, the hinge is configured with a very simple structure and therefore can be prepared at a low cost.

What is claimed is:

1. A hinge comprising a pair of movable members arranged within a casing for being rotated with a rotary shaft to be rigidly fitted to a swing door, a space between said movable members being filled with a viscous fluid, said hinge further comprising a spring carrier so arranged between said rotary shaft and said movable members that it can be engaged with and disengaged from said movable members by means of a spring one-way clutch for being rotated with said movable members only in one direction, said hinge further comprising a movable cam so arranged as to be rotatable with and axially slidable relative to said rotary shaft and a fixed cam so arranged as to be capable of being engaged with said movable cam, a spring being disposed between said spring carrier and said movable cam within said housing, an end of said spring being held by said spring carrier and the other end being axially slidably hooked to said casing, said movable and fixed cams being so configured that a torque is generated within the hinge to rotate the rotary shaft in one direction within a given range of rotation of the rotary shaft.

2. A hinge comprising a pair of movable members arranged within a casing for being rotated with a rotary shaft to be rigidly fitted to a swing door, a space between said movable members being filled with a viscous fluid, said hinge further comprising a spring carrier so arranged between said rotary shaft and said movable members that it can be engaged with and disengaged from said movable members by means of a spring one-way clutch for being rotated with said movable members only in one direction, said hinge further comprising a movable cam so arranged as to be rotatable with and axially slidable relative to said rotary shaft and a fixed cam so arranged as to be capable of being engaged with said movable cam, a spring being disposed between said spring carrier and said movable cam within said housing, an end of said spring being held by said spring carrier and the other end being axially slidably hooked to said casing. said movable and fixed cams being so configured that a torque is generated within the hinge to rotate the rotary shaft in the same direction of rotation of the opening of the door in the initial stages of the opening operation and within a given range of rotation of the rotary shaft.

* * * * *